US010874233B2

(12) United States Patent
Santiago

(10) Patent No.: US 10,874,233 B2
(45) Date of Patent: Dec. 29, 2020

(54) DECORATIVE LIGHTED COVER FOR WATER JUGS

(71) Applicant: Joseph Luis Santiago, Las Vegas, NV (US)

(72) Inventor: Joseph Luis Santiago, Las Vegas, NV (US)

( * ) Notice: Subject to any disclaimer, the term of this patent is extended or adjusted under 35 U.S.C. 154(b) by 0 days.

(21) Appl. No.: 16/563,775

(22) Filed: Sep. 6, 2019

(65) Prior Publication Data

US 2020/0077821 A1 Mar. 12, 2020

Related U.S. Application Data

(63) Continuation-in-part of application No. 29/669,675, filed on Nov. 9, 2018.

(60) Provisional application No. 62/727,944, filed on Sep. 6, 2018.

(51) Int. Cl.

| | |
|---|---|
| ***A47G 19/22*** | (2006.01) |
| ***A47G 23/03*** | (2006.01) |
| ***F21V 33/00*** | (2006.01) |
| ***F21Y 115/10*** | (2016.01) |

(52) U.S. Cl.

CPC ..... *A47G 19/2227* (2013.01); *A47G 23/0309* (2013.01); *F21V 33/0036* (2013.01); *A47G 2019/2238* (2013.01); *A47G 2200/08* (2013.01); *F21Y 2115/10* (2016.08)

(58) Field of Classification Search

CPC ..... A47G 19/2227; A47G 23/0309; A47G 2019/2238; A47G 2200/08; F21V 33/0036; F21Y 2115/10

See application file for complete search history.

(56) References Cited

U.S. PATENT DOCUMENTS

| | | | | |
|---|---|---|---|---|
| 5,518,168 | A * | 5/1996 | Mayer | B65D 5/58 229/102 |
| 7,740,368 | B2 * | 6/2010 | Chiang | B65D 51/248 362/101 |
| 8,814,379 | B2 | 8/2014 | Griffiths et al. | |
| 9,322,520 | B1 * | 4/2016 | Li | G02B 6/0011 |
| 9,706,831 | B2 * | 7/2017 | Wu | A45F 5/10 |

(Continued)

FOREIGN PATENT DOCUMENTS

| | | |
|---|---|---|
| WO | WO2006054958 A1 | 5/2006 |
| WO | WO2007106125 A2 | 9/2007 |
| WO | WO2016153122 A1 | 9/2016 |

OTHER PUBLICATIONS

"LED Bottle Lights Sticker Pads for Display Best Price Factory Supply", https://www.alibaba.com/product-detail/LED-bottle-lights-sticker-pads-for_60182843641.html?spm=a2700.7724857.normalList.1.35d87dfch9QhiZ.

(Continued)

*Primary Examiner* — Mary Ellen Bowman

(57) ABSTRACT

A decorative lighted cover for water jugs has an outer cover traversing between a top and a bottom end, with a design cutout traversing laterally through the outer cover and a light source located interior to the outer cover. The light source illuminates the interior of the outer cover, and the illumination is visible through the design cutout. An upper cover obstructs the top end of the outer cover and supports the light source near the top end. The outer cover is affixed around a water cooler's reservoir, and the illuminated design cutout provides an aesthetically pleasing appearance.

8 Claims, 7 Drawing Sheets

(56) References Cited

U.S. PATENT DOCUMENTS

| | | | | |
|---|---|---|---|---|
| 10,120,125 | B1 * | 11/2018 | Kuo | G02B 6/0095 |
| 2009/0213577 | A1 * | 8/2009 | Chen | A47G 19/2227 362/101 |
| 2013/0105434 | A1 * | 5/2013 | Levy | B65D 47/243 215/228 |
| 2014/0300273 | A1 * | 10/2014 | LeBrun | A47G 19/2227 315/76 |
| 2017/0367460 | A1 * | 12/2017 | Martines | A45D 40/18 |
| 2019/0202611 | A1 * | 7/2019 | Duarte Da Cal | A47G 19/2227 |
| 2019/0216243 | A1 * | 7/2019 | Honig | F21V 7/00 |

OTHER PUBLICATIONS

"New Product LED Wine Bottle Night Light Magic Cork Shaped USB Rechargeable Cork Stopper Cap Lamp Creative Romantic White Light", https://www.alibaba.com/product-detail/New-Product-LED-Wine-Bottle-Night_60727140374.html?spm=a2700.7724857.normalList.157.1c257dfccZqCd9.

"Solar-Powered Illuminating Waterbottle", https://www.uncommongoods.com/product/solar-powered-Iluminating-waterbottle.

* cited by examiner

DECORATIVE LIGHTED COVER FOR WATER JUGS

The current application claims a priority to the U.S. Provisional Patent application Ser. No. 62/727,944 filed on Sep. 6, 2018.

FIELD OF THE INVENTION

The present invention relates generally to decorative covers. More particularly, the present invention relates to decorative covers for water jugs.

BACKGROUND OF THE INVENTION

A water dispenser, also commonly known as water cooler, is a machine that stores and dispenses water, typically for human consumption, and may include cooling functionality with a refrigeration unit. Water coolers come in a variety of form factors, ranging from wall-mounted to bottle filler water cooler combination units, to bi-level units and other formats. They are generally broken up in two categories: point-of-use (POU) water coolers and bottled water coolers. POU Water coolers are connected to a water supply, while bottled water coolers require delivery (or self-pick-up) of water in large bottles from vendors. Bottled water coolers can be top-mounted or bottom-loaded, depending on the design of the model.

Bottled water coolers typically use 5 or 10-gallon water jugs commonly found on the top of the unit, which are depleted over time through water consumption and eventually must be refilled or replaced. The water jug occupies a significant amount of space, and thus it may frequently draw the eyes of bystanders despite its typically plain appearance. The present invention seeks to provide an enhanced aesthetically pleasing appearance for bystanders to observe. The present invention may be used during sporting events, holidays, other events, or for everyday use, to display relevant logos, characters, text, or other visual elements as desired.

Additional advantages of the invention will be set forth in part in the description which follows, and in part will be obvious from the description, or may be learned by practice of the invention. Additional advantages of the invention may be realized and attained by means of the instrumentalities and combinations particularly pointed out in the detailed description of the invention section. Further benefits and advantages of the embodiments of the invention will become apparent from consideration of the following detailed description given with reference to the accompanying drawings, which specify and show preferred embodiments of the present invention

DETAIL DESCRIPTIONS OF THE INVENTION

All illustrations of the drawings are for the purpose of describing selected versions of the present invention and are not intended to limit the scope of the present invention. The present invention is to be described in detail and is provided in a manner that establishes a thorough understanding of the present invention. There may be aspects of the present invention that may be practiced or utilized without the implementation of some features as they are described. It should be understood that some details have not been described in detail in order to not unnecessarily obscure focus of the invention. References herein to "the preferred embodiment", "one embodiment", "some embodiments", or "alternative embodiments" should be considered to be illustrating aspects of the present invention that may potentially vary in some instances, and should not be considered to be limiting to the scope of the present invention as a whole.

The present invention is a decorative lighted cover for water jugs. More particularly, the present invention is a cover that can be placed over and around a water jug or other reservoir for a water cooler or any other relevant object. A design is cut into the side of the present invention, and the present invention is illuminated from its interior, providing an aesthetically pleasing appearance to observers while still allowing the user to observe the amount of water retained within the water jug. The present invention may in some instances be known as an "H2shO Water Bottle Enhancement" or similar names.

Figure 1:
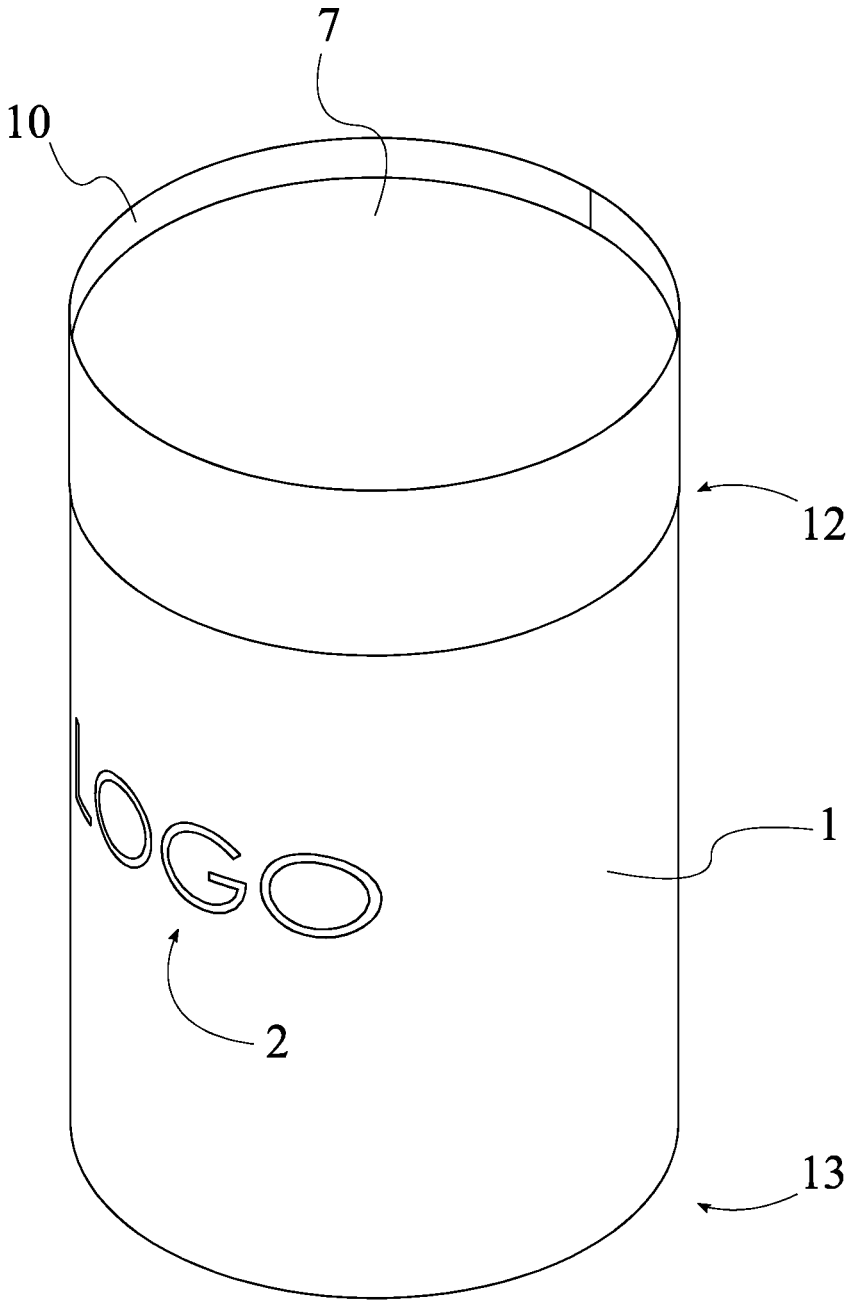
FIG. 1 is an elevated perspective view of the present invention.
Figure 2:
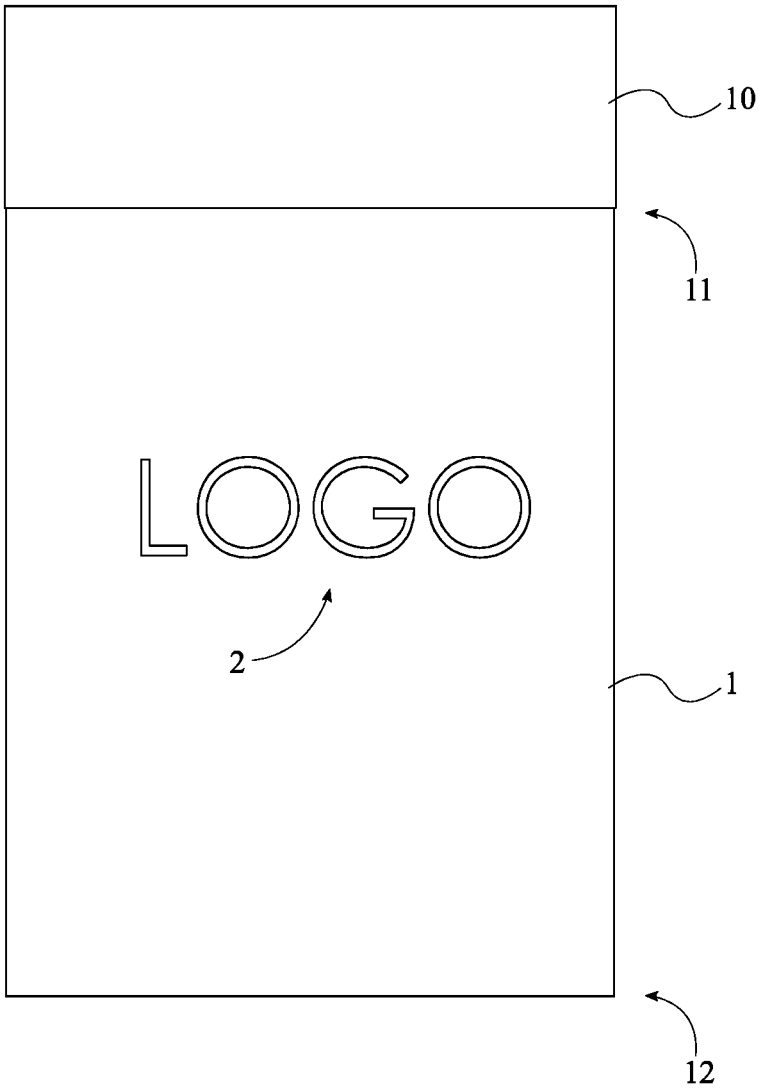
FIG. 2 is a front view of the present invention.
Figure 3:
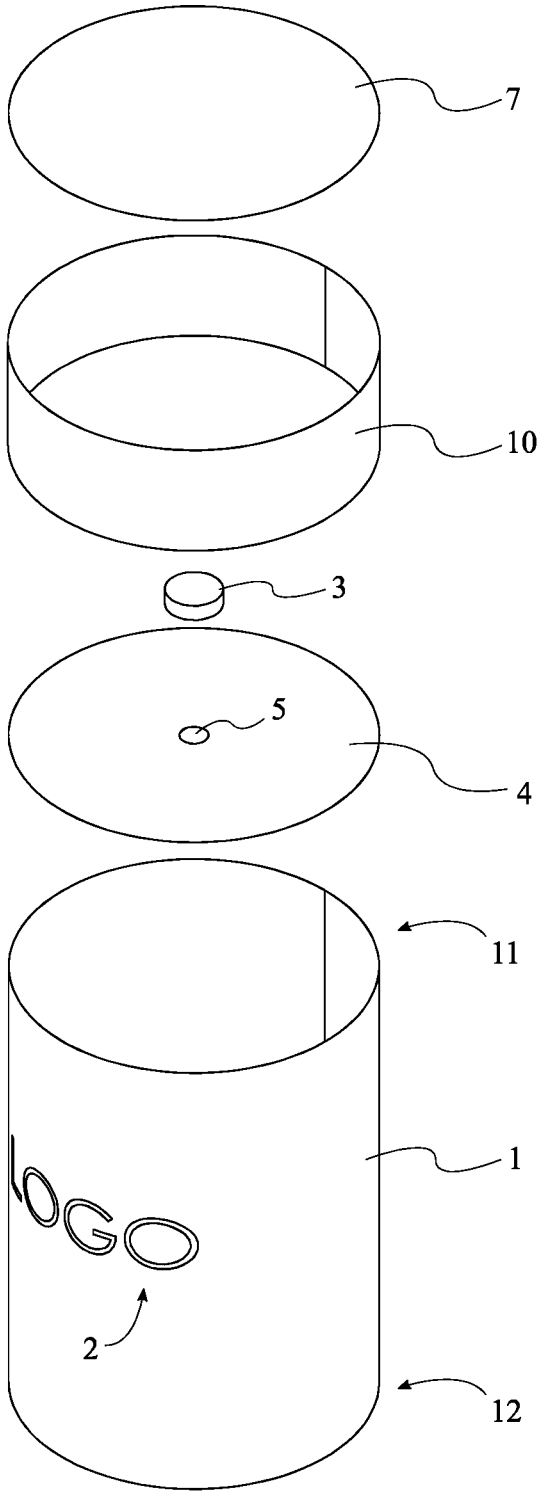
FIG. 3 is an elevated exploded perspective view of the present invention.
Figure 4:
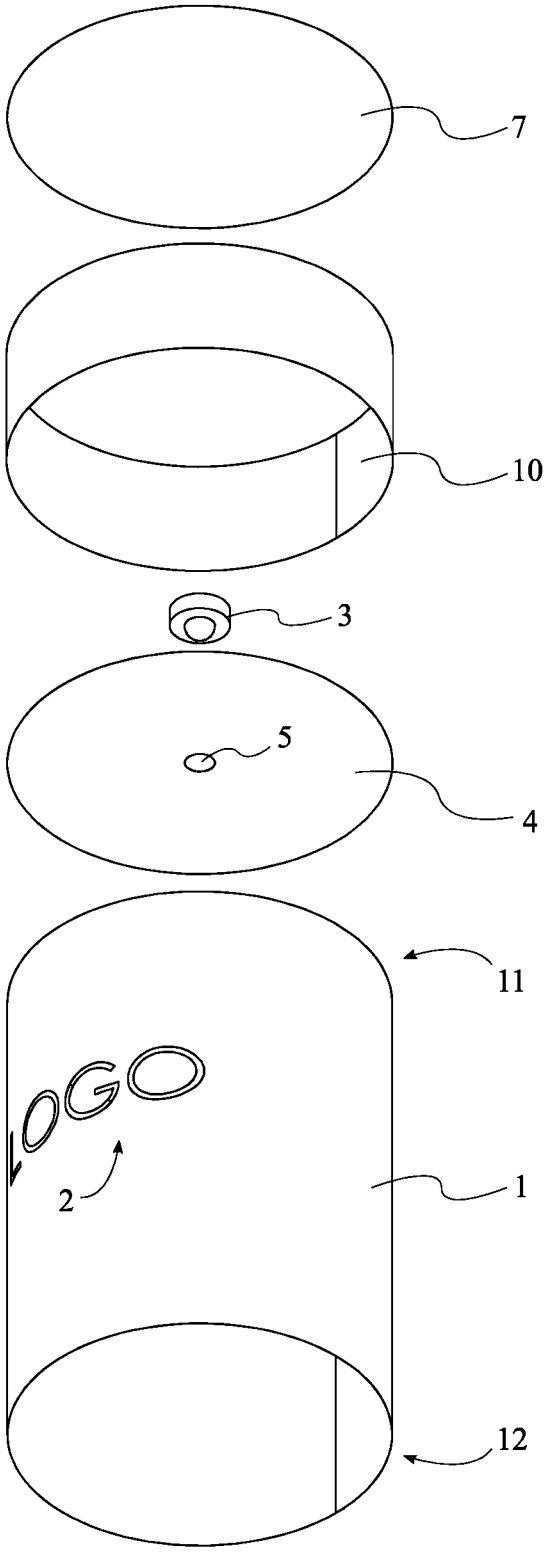
FIG. 4 is a lowered exploded perspective view of the present invention.
Figure 5:
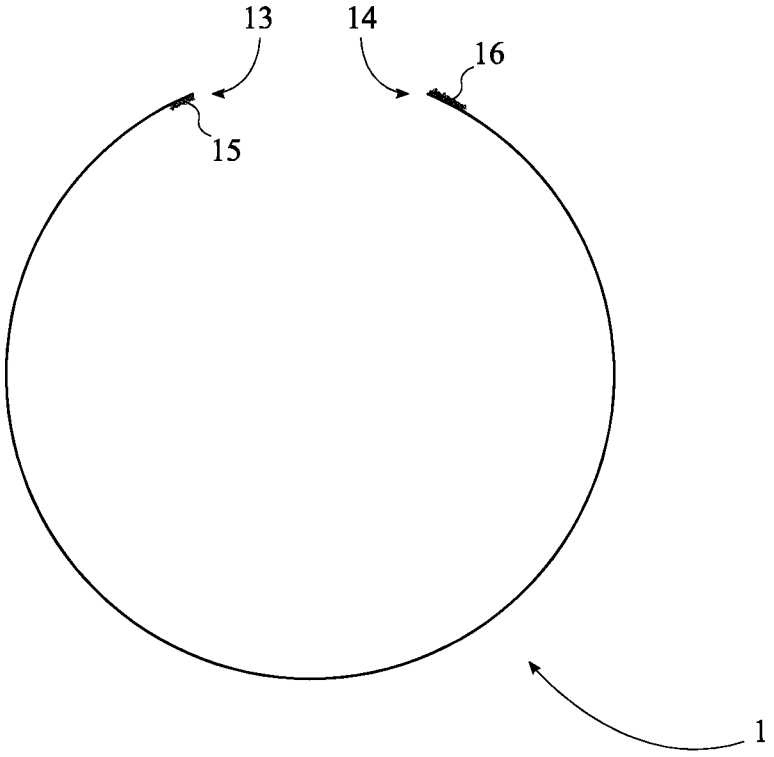
FIG. 5 is a top view of one embodiment of the outer cover showing the first and second fastening elements as hook and loop tape.
Figure 6:
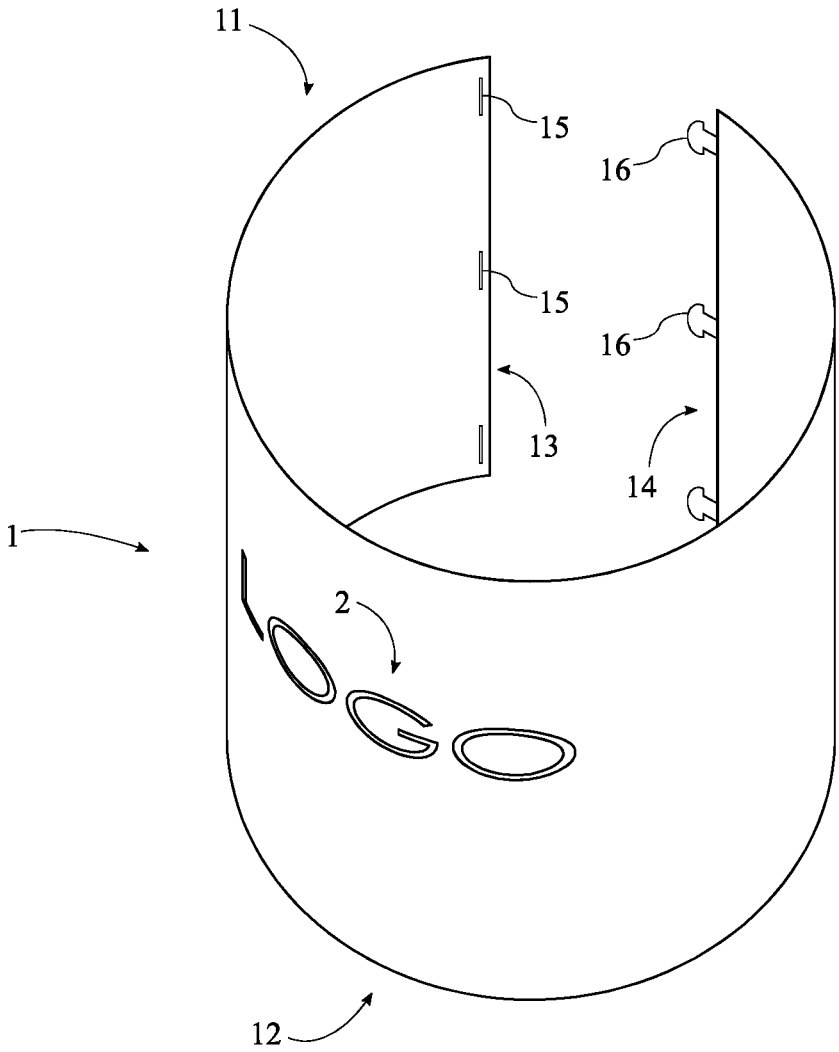
FIG. 6 is an elevated perspective view of one embodiment of the outer cover showing the first and second fastening elements as tabs and slots.
Figure 7:
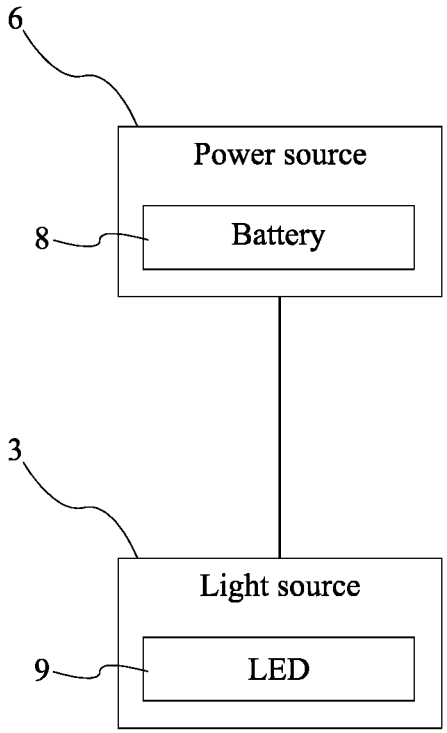
FIG. 7 is a diagram of the electrical components of the present invention.

In general, as shown in FIGS. 1-7, the present invention comprises an outer cover 1, a design cutout 2, a light source 3, an upper cover 4, and a power source 6. The outer cover 1 traverses vertically between a top end 11 and a bottom end 12 and is generally hollow and cylindrical. More specifically, the water jug or other relevant object over which the present invention is intended to be installed onto is assumed to be generally cylindrical and oriented vertically, as typical of water cooler jugs. The outer cover 1 concentrically encloses the water jug, and an axis of the outer cover 1's generally cylindrical shape is oriented similarly to that of the water jug. In the preferred embodiment of the present invention, the outer cover 1 is made of a flexible material, though this is not considered to be a strict requirement. In some embodiments, the outer cover has a diameter of approximately 36 inches, though this may vary in different embodiments to accommodate different sizes of water jugs.

In various embodiments, the outer cover 1 may be made of various different materials, such as, but not limited to, paper, plastic, metal, wood, or any other suitable material. In some embodiments, the outer cover 1 may be made of a translucent material to enhance the aesthetic quality of the interior lighting of the present invention. In various embodiments, the various structural components of the present invention may be made of various materials, flexible or rigid, that are suited to facilitating the spirit and purpose of the present invention.

The design cutout 2 laterally traverses through the outer cover 1 between the top end 11 and the bottom end 12, the lateral direction being understood to be perpendicular to the vertical axis of the outer cover 1. The design cutout 2 may be customized to any design desired by the user, and may visually represent one or more company logos, figures, words, numbers, or any other visual elements that may be achieved through removing material from the outer cover 1.

In various embodiments of the present invention, the light source 3 may take any suitable form. In the preferred embodiment, the light source 3 comprises at least one light-emitting diode (LED) 9. More particularly, in the preferred embodiment, the light source 3 comprises three color-changing LEDs 9. In different embodiments, the light source 3 may comprise more or fewer than three LEDs 9, or may comprise different types of lighting sources, such as, but not limited to, incandescent, halogen, neon, fluorescent, or any other type of light bulb or other light source 3. The light source 3 is electrically connected to the power source 6 in order to illuminate the present invention, and may further be connected to a switch or other user interface element in order to turn the light source 3 on and off as desired. In the preferred embodiment, the power source 6 comprises a battery 8, though in alternative embodiments, the power source 6 may comprise a wired connection configured to be connected to an external power source 6, such as a wall socket or USB charging port.

In the preferred embodiment of the present invention, the upper cover 4 is a circular disk that is removably and concentrically attached to the outer cover 1 adjacent to the top end 11 of the outer cover 1. The upper cover 4 serves to position the light source 3 in the preferred embodiment and furthermore to conceal the interior of the outer cover 1 from above. The upper cover 4 is positioned perimetrically adjacent to the outer cover 1, thus eliminating any later space between the outer cover 1 and the upper cover 4. In the preferred embodiment, the light source 3 is connected to the upper cover 4 and is oriented toward the bottom end 12 of the outer cover 1; thus, light emitted by the light source 3 illuminates the interior of the outer cover 1, and shines through the negative space of the design cutout 2. In some embodiments, the upper cover 4 may be attached to the outer cover 1 using hook and loop tape, or any other suitable fasteners or fastening means.

The preferred embodiment of the present invention further comprises a top cover 7 and a cover connector 10. The top cover 7 serves to provide a plain appearance to the top of the present invention, so that the light source 3, power source 6, or any other interior components are concealed. The top cover 7 is removably and concentrically attached atop the upper cover 4 through the cover connector 10. More specifically, the cover connector 10 is perimetrically attached to the upper cover 4 opposite the outer cover 1 along the upper cover 4, and the top cover 7 is perimetrically attached to the cover connector 10 opposite the upper cover 4 along the cover connector 10. Thus, the outer cover 1, the upper cover 4, and the top cover 7 are concentrically aligned with each other. In various embodiments, the cover connector 10 is perimetrically attached to the upper cover 4 and the top cover 7 is in turn attached to the cover connector 10 through hook and loop tape, corresponding tabs and slots, or any other suitable fasteners or fastening means.

It should be noted that the top cover 7 and cover connector 10 are considered to be optional, and the present invention will serve its intended purpose with only the outer cover 1 and the upper cover 4 as the structural components of the present invention. In some embodiments, the cover connector 10 and the upper cover 4 are not utilized, and instead the top cover 7 is connected directly to the top end 11 of the outer cover 1, either by strips of hook and loop tape, tabs and slots, or other fasteners or fastening means. Furthermore, the light source 3 would be affixed to the underside of the top cover 7 in such embodiments through any relevant means, such as, but not limited to, glue or other adhesives, hook and loop tape, or other fastening means.

Furthermore, in the preferred embodiment, the upper cover 4 comprises an aperture 5. The aperture 5 centrally traverses through the upper aperture 5, and the light source 3 is positioned concentrically with the aperture 5. More specifically, the light source 3 may comprise a structural base and at least one lighting element; the structural base may rest or be fastened atop the upper cover 4 adjacent to the aperture 5, while the at least one lighting element traverses through the aperture 5. Thus, the light source 3 is supported at the top end 11 of the outer cover 1 and sufficiently illuminates the interior of the outer cover 1. In the preferred embodiment, the light source 3 may be controlled wirelessly by a remote so that the user may turn off the light source 3 to conserve battery when not in use or to change the illumination level or color emitted by the light source 3.

In some embodiments, the components of the present invention may be provided to the user in a disassembled configuration. In some embodiments, in the disassembled configuration, the outer cover 1 may be a rectangular sheet of material whose ends are joined together to form a cylinder. To this end, referring to FIGS. 5-6, the outer cover 1 may comprise a first lateral end 13, a second lateral end 14, a first fastening element 15, and a second fastening element 16. The first fastening element 15 is connected adjacent to the first lateral end 13 of the over cover, and the second fastening element 16 is connected adjacent to the second lateral end 14 of the outer cover 1. The first fastening element 15 and the second fastening element 16 are removably attached to each other, wherein the outer cover 1 is in an assembled configuration when the first fastening element 15 and the second fastening element 16 are attached to each other, and wherein the outer cover 1 is cylindrical in the assembled configuration. The outer cover 1 should be in the assembled configuration while installed over a water jug. The first fastening element 15 and the second fastening element 16 may take the form of any suitable fastening element, such as, but not limited to, hook and loop tape, tabs and slots, snaps, hooks, clamps, or other fastening elements. In the preferred embodiment, the first fastening element 15 and the second fastening element 16 each comprise at least one hook and loop tape portion.

In some embodiments, a process of installing the present invention over a water jug is as follows. The outer cover 1 is wrapped around the water jug so that the first lateral end 13 and the second lateral end 14 meet and the first fastening element 15 is attached to the second fastening element 16. The cover connector 10 may also comprise hook and loop fasteners at its lateral ends, similar to the outer cover 1, as well as along the perimeter between its lateral ends. Further, the upper cover 5 may comprise hook and loop fastener along its perimeter. The lateral ends of the cover connector 10 are attached together through the aforementioned hook and loop fasteners, and the perimeter hook and loop fastener of the upper cover 4 is attached to the perimeter hook and loop fastener of the cover connector 10. Finally, the top cover 7 is placed atop the cover connector 10. The top cover 7 may comprise a perimeter lip that allows the top cover 7 to sit flush atop the cover connector 10, or the top cover 7 may comprise its own hook and loop tape fasteners or other type of fasteners or fastening means to be attached to the cover connector 10 in various embodiments.

Although the invention has been explained in relation to its preferred embodiment, it is to be understood that many other possible modifications and variations can be made without departing from the spirit and scope of the invention as hereinafter claimed.

What is claimed is:

1. A decorative lighted cover for water jugs comprises:

a single outer cover vertically traversing between a top end and a bottom end;

a design cutout;

a light source;

an upper cover;

a power source;

the design cutout laterally traversing through the single outer cover in a lateral direction perpendicular to a vertical axis of the single outer cover;

the design cutout being positioned in between the top end and the bottom end;

the upper cover being removably and concentrically attached to the single outer cover adjacent to the top end of the single outer cover;

the light source being connected to the upper cover;

the light source being oriented toward the bottom end of the single outer cover;

the light source being electrically connected to the power source;

the single outer cover comprising a first lateral end, a second lateral end, a first fastening element and a second fastening element;

the first fastening element being connected adjacent to the first lateral end of the single outer cover;

the second fastening element being connected adjacent to the second lateral end of the single outer cover;

the first fastening element and the second fastening element being removably attached to each other, wherein the single outer cover is in an assembled configuration when the first fastening element and the second fastening element are attached to each other;

the upper cover comprising an aperture;

the aperture centrally traversing through the upper cover; and the light source being positioned concentrically with the aperture.

2. The decorative lighted cover for water jugs as claimed in claim 1 comprises:

a top cover;

the top cover being removably and concentrically attached atop the upper cover;

a cover connector;

the cover connector being perimetrically attached to the upper cover opposite the single outer cover along the upper cover;

the top cover being perimetrically attached to the cover connector opposite the upper cover along the cover connector;

the single outer cover, the upper cover and the top cover being concentrically aligned with each other.

3. The decorative lighted cover for water jugs as claimed in claim 1 comprises:

the power source comprising a battery.

4. The decorative lighted cover for water jugs as claimed in claim 1 comprises:

the light source comprising at least one light-emitting diode (LED).

5. The decorative lighted cover for water jugs as claimed in claim 1 comprises:

the light source comprising three color-changing LEDs.

6. The decorative lighted cover for water jugs as claimed in claim 1 comprises:

the single outer cover being made of a flexible material.

7. The decorative lighted cover for water jugs as claimed in claim 1, wherein the single outer cover is cylindrical in the assembled configuration.

8. The decorative lighted cover for water jugs as claimed in claim 1 comprises:

the first fastening element and the second fastening element each comprising at least one hook and loop tape portion.

* * * * *